United States Patent [19]

Barnhart

[11] Patent Number: 4,878,544

[45] Date of Patent: Nov. 7, 1989

[54] COMPACTION ROLLER

[76] Inventor: James Barnhart, 6144 Columbia, Haslott, Mich. 48840

[21] Appl. No.: 183,823

[22] Filed: Apr. 20, 1988

[51] Int. Cl.[4] ..... A01B 29/02; A01B 35/18

[52] U.S. Cl. ..... 172/40; 172/125; 172/464; 404/117

[58] Field of Search ..... 172/40, 668, 483, 452, 172/68, 149, 150, 175, 199, 784, 125; 404/117, 103, 122, 128; 37/DIG. 3

[56] References Cited

U.S. PATENT DOCUMENTS

| | | | |
|---|---|---|---|
| 2,721,405 | 10/1955 | Gardner | 172/784 |
| 2,990,632 | 7/1961 | Noblin | 172/149 X |
| 3,176,597 | 4/1965 | Seaman | 404/117 |
| 3,508,617 | 4/1970 | Paynter | 172/68 |
| 3,605,583 | 9/1971 | Keppler | 404/117 |
| 3,623,407 | 11/1971 | Dresher | 404/117 |
| 3,756,203 | 9/1973 | Dedoes | 172/668 X |
| 3,876,013 | 4/1975 | Dunn | 172/150 X |
| 3,993,413 | 11/1976 | Cox et al. | 172/452 X |
| 4,098,344 | 7/1978 | Johnson | 172/40 |
| 4,193,710 | 3/1980 | Pietrowski | 404/128 |
| 4,252,376 | 2/1981 | Gurries | 172/40 X |
| 4,269,535 | 5/1981 | Schultz | 404/117 |
| 4,378,052 | 3/1983 | Anderson | 172/449 |
| 4,714,295 | 12/1987 | Wirtgen | 172/483 X |

FOREIGN PATENT DOCUMENTS

| | | | |
|---|---|---|---|
| 1924440 | 11/1970 | Fed. Rep. of Germany | 404/117 |
| 2244385 | 3/1974 | Fed. Rep. of Germany | 172/68 |
| 1245729 | 9/1971 | United Kingdom | 172/40 |

*Primary Examiner*—Richard J. Johnson
*Assistant Examiner*—Jeffrey L. Thompson
*Attorney, Agent, or Firm*—Reising, Ethington, Barnard, Perry & Milton

[57] ABSTRACT

A compaction roller machinery assembly (10) suspended from the rear of a bulldozer (12) for compacting surfaces such as sand. The assembly (10) includes a vehicle (12) having a power plant for driving the assembly, a vibratory compaction roller (18) extending in a cantilevered fashion from a pivot axis on the vehicle for compacting a surface and a roller lift assembly (20) mounted to the vehicle (12) and interconnecting the vibratory compaction roller (18) and the vehicle (12) raising and lowering the vibratory compaction roller (18) about the pivot axis between a raised position and a surface engaged position. The vibratory compaction roller (18) includes a roller (22) for rolling and compacting surfaces and a vibration producing mechanism for vibrating the roller to facilitate the compaction of the surfaces. In addition, the assembly includes a first and second hydraulic pump disposed on the vehicle (12) for supplying hydraulic power to the roller lift assembly for raising and lowering the roller and to the hydraulic vibration producing mechanism (24) on the vibratory compaction roller (18) to vibrate the roller (22) to facilitate the compaction of the surface.

13 Claims, 3 Drawing Sheets

COMPACTION ROLLER

BACKGROUND OF THE INVENTION

(1) TECHNICAL FIELD

The subject invention relates to a hydraulic vibratory compaction roller adapted to be permanently and pivotally connected to the back of a vehicle.

(2) DESCRIPTION OF THE PRIOR ART

Compaction rollers are well known in the art and are employed, for example, by construction contractors who are involved in digging operations. For instance, when laying sewer pipes, the construction contractors are required to compact the soil tightly when back filling trenches. To accomplish this, contractors employ large independently driven roller machines with large drum rollers located on the front, similar to the type used to compact asphalt during road paving. This invention, however, relates to tow type vibratory compaction rollers adapted to be towed behind bulldozers, or the like, to compact the back fill in the trenches.

For example, U.S. Pat. No. 3,623,407 issued to Dresher on Nov. 30, 1971 discloses a vibratory compaction roller which includes a hitch and a source of hydraulic power mounted to the back of a bulldozer. The compaction roller is permanently attached to the back of the bulldozer and includes a frame in the form of a yoke and a tow bar. A drum is rotatably mounted in the arm of the yoke. Although the roller is permanently attached to the back of the bulldozer, the Dresher '407 patent does not disclose a roller lift means for raising and lowering the roller nor a first and second hydraulic pump for supplying hydraulic power to both the hydraulic cylinder or the roller lift means and the hydraulic vibration producing means on the roller.

Compaction rollers adapted to be towed behind vehicles and including roller lift means are also known in the art and shown in U.S. Pat. No. 4,378,052 issued to Anderson on Mar. 29, 1983. The Anderson '052 patent discloses an articulated tractor attachment with roller including a three part hitch and a hydraulic cylinder for raising and lowering the roller. However, the Anderson '052 patent does not disclose any means for vibrating the roller.

Detachable tow type compaction rollers are difficult to hitch to and from machinery and this can also be time consuming. In addition, detachable tow type compaction rollers are presently manufactured with vibration producing motors for vibrating the drum rollers which aid in the compaction process. These motors increase the cost of the detachable tow type compaction rollers.

SUMMARY OF THE INVENTION AND ADVANTAGES

The subject invention relates to a vibratory compaction roller machinery assembly for compacting surfaces such as sand. The assembly includes a vehicle having a power plant, such as a bulldozer, for driving the assembly, roller means extending in a cantilevered fashion from a pivot axis on the bulldozer for compacting the surface and roller lift means mounted to the bulldozer and interconnecting the roller means and the bulldozer for raising and lowering the roller means about the pivot axis between a raised position and a surface engaged position. The roller means includes a roller for rolling and compacting surfaces and vibration producing means for vibrating the roller to facilitate the compaction of the surfaces. The assembly is characterized by including first and second hydraulic pump means disposed on the bulldozer for supplying hydraulic power to the roller lift means for raising and lowering the roller and to the hydraulic vibration producing means on the roller means to vibrate the roller to facilitate compaction of the surface.

The present invention overcomes all of the aforementioned problems by incorporating an inexpensive vibratory compaction roller adapted to be pivotally and permanently connected to the back of a vehicle having a power plant which includes means for raising and lowering the roller for selective use of the compaction roller. No time is wasted attaching and removing the roller as it is permanently affixed to the back of the vehicle and may be raised by the roller lift means when not in use. Finally, the present invention eliminates the need for an auxiliary power source on the roller means for powering the vibration producing means as required by tow type compaction rollers by employing first and second hydraulic pump means disposed on the vehicle for supplying hydraulic power to the roller lift means for raising and lowering the roller and to the hydraulic vibration producing means on the compaction roller to vibrate the roller to facilitate the compaction of the surface.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
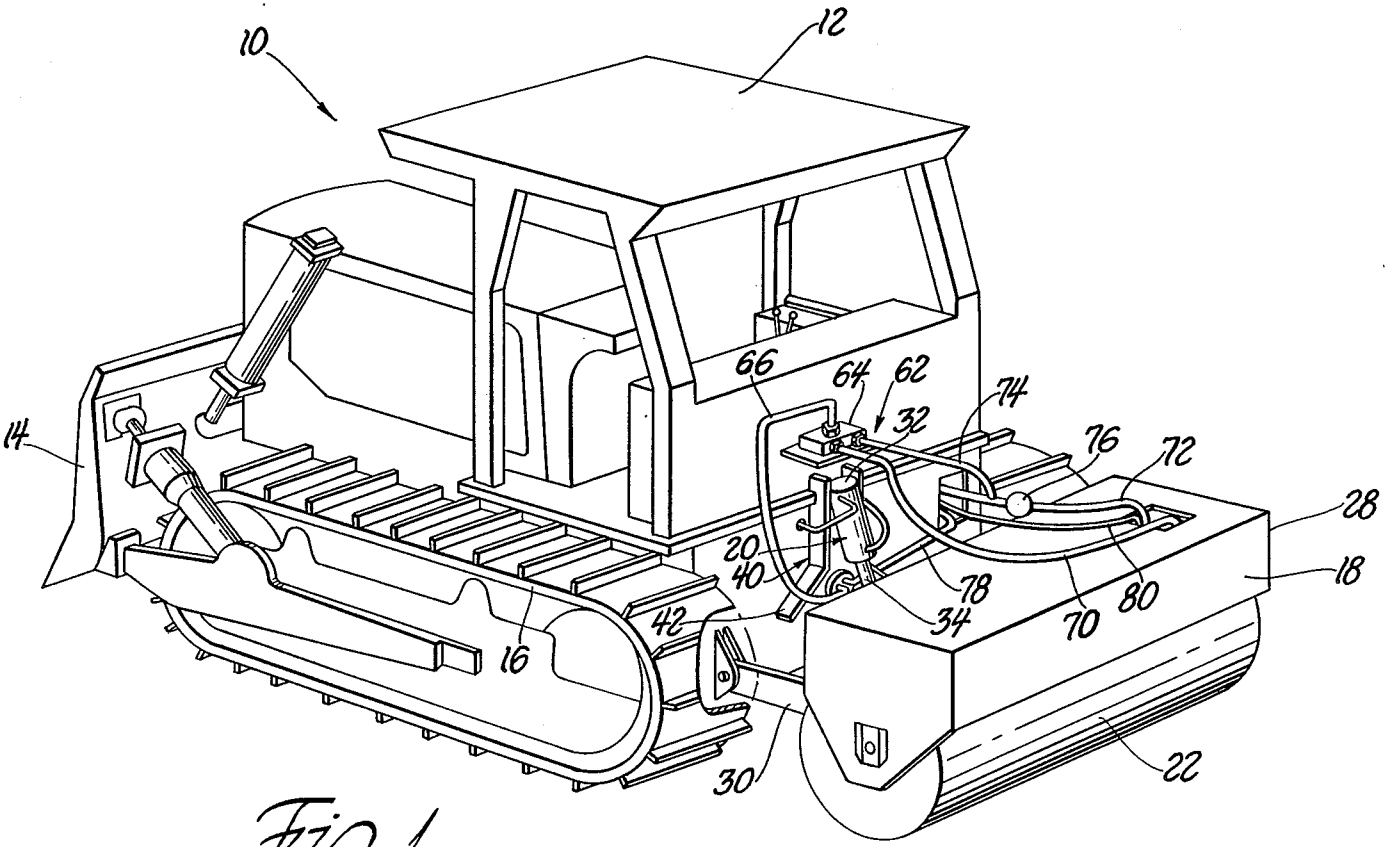
FIG. 1 is a perspective view of the compaction roller machinery assembly of the subject invention.
Figure 2:
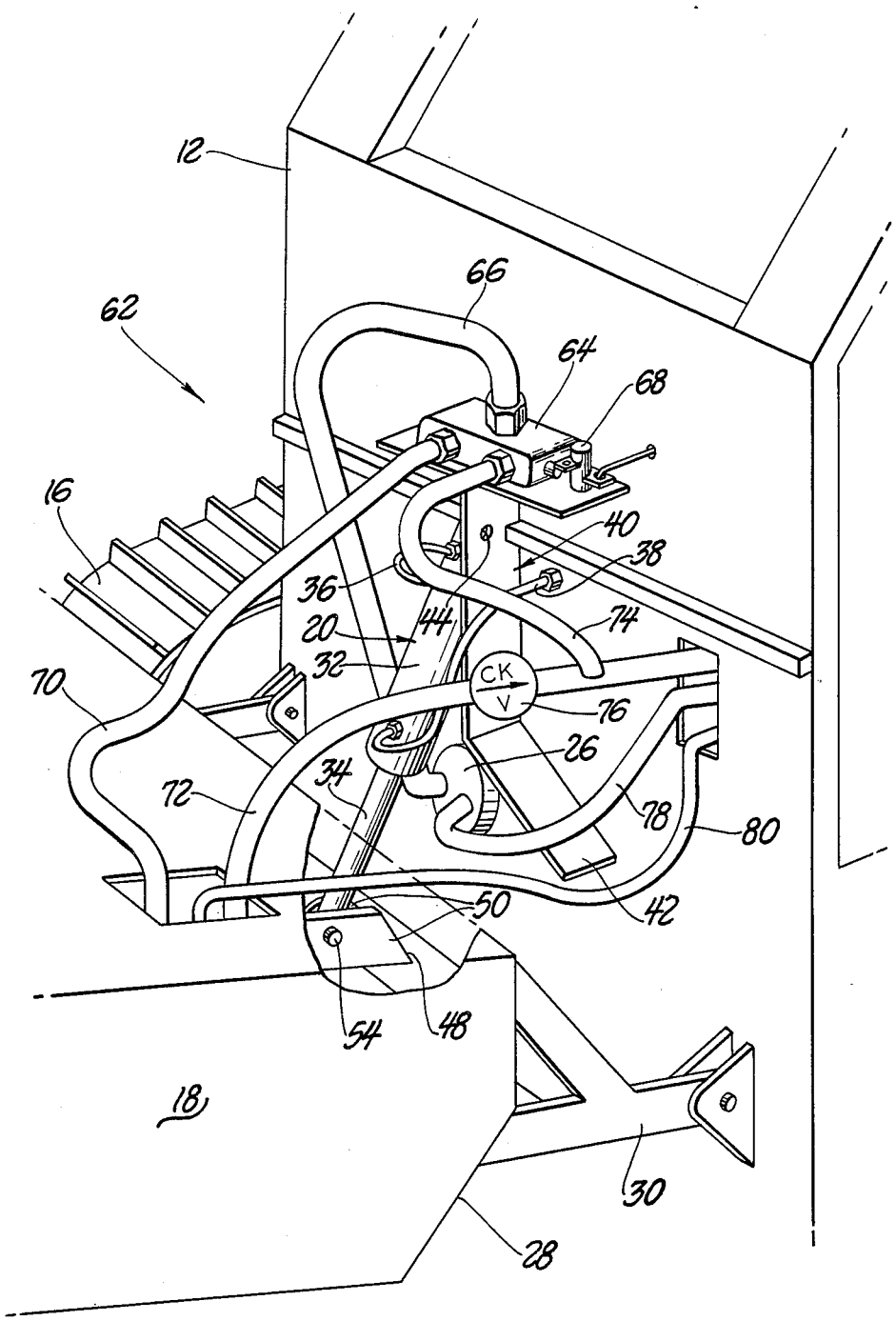
FIG. 2 is a perspective view of the vibratory compaction roller and the roller lift means mounted at the back of the machinery.

A compaction roller machinery assembly for compacting surfaces such as sand is generally shown at 10 in FIG. 1. The assembly includes a vehicle including a power plant 12, such as a bulldozer, for driving said assembly. The bulldozer 12 is of the conventional type including a blade 14 disposed at the front of the bulldozer and a pair of endless tracks 16 which aid in the bulldozer's maneuverability in areas where tire traction is poor. The assembly 10 further includes a vibratory compaction roller means 18 extending in a cantilevered fashion from a pivot axis on the bulldozer 12 for compacting a surface and roller lift means, generally indicated at 20, mounted to the bulldozer 12 and interconnecting the roller means 18 and the bulldozer 12 for raising and lowering the roller means 18 about the pivot axis between a raised position and a surface engaged position. The vibratory compaction roller means 18 includes a roller 22 for rolling and compacting surfaces and a vibration producing means 24, schematically represented in FIG. 3, for vibrating the roller to facilitate the compaction of the surfaces. The vibration producing means 24 may be of any type commonly known in the art and for example, as shown in the U.S. Pat. No. 3,623,407 issued to Dresher and directed toward a vibratory compaction roller. The assembly also includes a first and second hydraulic pump means disposed on the driven machinery 12 for supplying hydraulic power to the roller lift means for raising and lowering the roller means 18 and to the hydraulic vibration producing means 24 on the roller means 18 to vibrate the roller 22 to facilitate the compaction of the surface. The roller means 18 includes a housing 28. The vibration producing means 24 and the roller 22 are disposed within the housing 28. The assembly 10 includes a pair of stabilizers 30 extending in a cantilevered fashion from the pivot axis on the vehicle and between the housing 28 and the vehicle 12 and in parallel spaced relationship with respect to one another. The stabilizers 30 are fixedly secured at one end to the housing 28 and pivotally connected at the opposite end to the bulldozer 12.

The roller lift means 20 includes a hydraulic cylinder 32 having a piston (not shown) moveable therein between first and second positions and a rod 34 extending from the piston exteriorly of the cylinder 32. The hydraulic cylinder 32 receives hydraulic pressure from the first hydraulic pump located within the driven machinery. The first hydraulic pump typically delivers hydraulic power to the piston cylinders which raise the blade 14 and is adapted to also power hydraulically operated attachments to the driven machinery 12. Accordingly, the first hydraulic pump is also employed for supplying the roller lift means 20 with hydraulic power for carrying and raising the roller means 18. A piston delivery passage 36 is employed for providing positive fluid pressure to one side of the piston in the cylinder 32 to move the rod 34 to its extended position. A piston return passage 38 provides positive fluid to the other side of the piston in the cylinder 32 to move the rod 34 to its retractable position to lift the roller means 18.

The roller lift means 20 also includes a cylinder support means, generally indicated at 40. The cylinder 32 is pivotally connected at one end to the cylinder support means 40. The hydraulic cylinder 32 raises the roller means 18 to the raised position when the rod 34 is moved to its retracted position and lowers the roller means 18 to the lowered position once the rod 34 is moved to its extended position. The cylinder support means 40 includes a pair of opposing flanges 42 disposed in spaced relationship with respect to one another and fixedly secured to the driven machinery 12. The hydraulic cylinder 32 includes a hole disposed at the end opposite to the rod 34 and the piston support means 40 includes a pin 44 disposed through the hole in the hydraulic cylinder 32. The pin 44 extends between the opposing flanges 42 for allowing the hydraulic cylinder 32 to pivot as the roller means 18 is raised and lowered. The housing 28 includes a mounting bracket 48. The mounting bracket 48 includes a U-shaped flange having opposing sides 50 spaced from one another. The rod 34 extending from the cylinder 32 includes a hole disposed at the distal end thereof. The mounting bracket 48 includes a mounting pin 54 disposed through the hole and extending between the opposing sides 50 of the U-shaped flange 48 for allowing the hydraulic cylinder 32 to pivot as the roller means 18 is raised and lowered.

Figure 3:
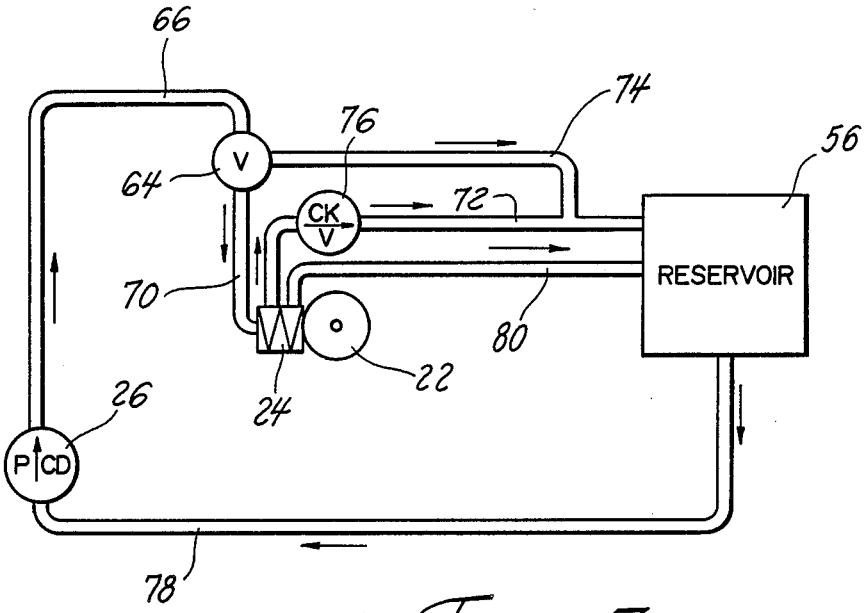
FIG. 3 is a schematic representation of the hydraulic system of the subject invention.

The bulldozer 12 includes a fluid oil reservoir 56, shown schematically in FIG. 3, for storing a quantity of fluid and a power take off shaft (not shown) continuously driven by the bulldozer 12. The second hydraulic pump means 26 includes a second hydraulic pump operatively connected to the driven machinery 12 at the power take off shaft for continuously driving the second hydraulic pump 26. The assembly includes fluid delivery means, generally indicated at 62, interconnecting the second hydraulic pump 26, the hydraulic vibration producing means 24 and the fluid reservoir 56 for providing fluid communication therebetween to facilitate the second hydraulic pump 26 operatively pumping fluid through the fluid delivery means 62 from the fluid reservoir 56 to the hydraulic vibration producing means 24 for vibrating the roller 22 and to pump fluid back to the reservoir 56. The delivery means 62 includes a valve means 64 and an arterial passage 66 extending between the valve means 64 and the second hydraulic pump 26 for providing fluid communication there between. The valve means 64 selectively regulates the flow of fluid to and from the vibration producing means 24 on the roller means 18. The delivery means 62 includes a control means 68 which is operatively connected to the valve means 64 for selectively controlling the valve means 64 to direct the flow of fluid to and from the vibratory producing means 24 on the roller means 18. The control means 68 is connected by a series of linkages, commonly known in the art, to the cab of the bulldozer 12 wherein an operator may control the control means 68 and therefore the valve means 64. The delivery means 62 also includes a compactor delivery passage 70 extending between the valve means 64 and the vibration producing means 24 for providing fluid communication therebetween. A compactor return passage 72 extends between the vibration producing means 24 and the fluid reservoir 56 for providing fluid communication therebetween. A bypass passage 74 extends between the valve means 64 and a point on the compactor return passage 72 for providing fluid communication between the valve means 64 and the compactor return passage 72 to bypass the vibration producing means 24 when the valve means 64 is in a predetermined bypass position. In this way, when the roller 22 is not being used, it may be raised by the roller lift means 20 and the hydraulic fluid, which is continuously pumped by the second hydraulic pump 26 operatively connected to the power take off shaft, may be diverted by the valve means 64 to the bypass passage 74 into the compactor return passage 72 then on to the reservoir 56 to "short circuit" the system and therefore bypass the vibration producing means 24. A check valve 76 is employed to prevent the back flow of hydraulic fluid toward the vibration producing means 24 through the compactor return passage 72. The delivery means 64 further includes a pump return passage 78 extending between the second pump means 26 and the fluid reservoir 56 for providing fluid communication therebetween. A fluid relief passage 80 extends between the vibration producing means 24 and the fluid reservoir 56. The relief passage 80 provides a path for fluid flow when the hydraulic fluid pressure of the hydraulic vibration producing means 24 exceeds a predetermined level. This may occur when, for instance, dirt, grit, or other substances find their way into the vibration producing means 24 thereby causing it to bind up. In this case, the hydraulic fluid pressure will rise until it exceeds a predetermined level wherein fluid may then be allowed to flow along the relief passage 80 back to the reservoir 56 thereby relieving this pressure and preventing any damage to the vibration producing means 24.

In its operative mode, the roller means 18 may be selectively lowered from the raised position to the surface engage position when the operator of the bulldozer 12 selectively directs hydraulic fluid to one side of the piston in the cylinder 32 of the roller lift means 20.

Further compactive force may be exerted on the surface to be compacted by means of the roller lift means 20. Hydraulic fluid is continuously pumped from the second hydraulic pump 26 through the arterial passage 66 to the valve means 64. When the vibratory compaction roller is in its lowered, surface engaged position the operator actuated control means 68 selectively regulates the valve means 64 to direct the flow of fluid through the compactor delivery passage 70 to the vibration producing means 24. The compactor return passage 72 allows the hydraulic fluid to return to the fluid reservoir 56. From the fluid reservoir 56, the hydraulic fluid is drawn back to the second hydraulic pump 26 through a pump return passage 78. When the vibratory compaction roller means 18 is not being used the operator of the driven machinery 12 may then actuate the control means 68 to selectively regulate the valve means 64 to direct the flow of fluid through the bypass passage 74 and then into the compactor return passage 72 and onto the fluid reservoir 56 thereby bypassing the vibration producing means 24. The check valve prevents any fluid from flowing back through the compactor return passage 72 into the vibration producing means 24.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A compaction roller machinery assembly (10) for compacting surfaces such as sand, said assembly (10) comprising; a vehicle (12) having a power plant for driving said assembly (10), roller means (18) extending in a cantilevered fashion from a pivot axis on said vehicle (12) for compacting a surface, said roller means (18) including a housing (28), roller lift means (20) mounted to said vehicle (12) and interconnecting said roller means (18) and said vehicle (12) for raising and lowering said roller means (18) about said pivot axis between a raised position and a surface-engaged position, said roller lift means (20) including a hydraulic cylinder (32) having a piston moveable therein between first and second positions and a rod (34) extending from the piston exteriorly of the cylinder (32) and a piston delivery passage (36) for providing positive fluid pressure to one side of the piston in said cylinder (32) to move said rod (34) to its extended position and a piston return passage (38) for providing positive fluid pressure to the other side of said piston in said cylinder (62) to move said rod (34) to its retracted position to lift said roller means (18), said roller lift means (20) further including a cylinder support means (40), said cylinder (32) pivotally connected at one end to said cylinder support means (40), said housing (28) including a mounting bracket (48), said rod (34) pivotally connected at the distal end to said bracket (48), said hydraulic cylinder (32) raising said vibratory compaction roller means (18) to said raised position when said rod (34) is moved to its retracted position and lowering said roller means (18) to said lowered position once said rod (934) is moved to its extended position, said roller means (18) including a roller (22) for rolling and compacting surfaces and vibration-producing means (24) for vibrating said roller (22) to facilitate the compaction of the surfaces, said assembly (10) characterized by including a first hydraulic pump means for supplying said roller lift means (20) with hydraulic power for raising and lowering said roller means (18) and a second hydraulic pump means (26) disposed on said vehicle (12) for supplying hydraulic power to said hydraulic vibration-producing means (24) on said roller means (18) to vibrate said roller (22) to facilitate the compaction of the surface.

2. An assembly as set forth in claim 1 further characterized by said vehicle (12) including a fluid oil reservoir (56) for storing a quantity of fluid, and a power take off shaft driven by said vehicle (12) said second hydraulic pump means (26) including a hydraulic pump operatively connected to said vehicle (12) at the power takeoff shaft for driving said hydraulic pump (26).

3. An assembly as set forth in claim 2 further characterized by including fluid delivery means (62) interconnecting said second hydraulic pump (26) with said hydraulic vibration producing means (24) and said fluid reservoir (56) for providing fluid communication therebetween and to facilitate said second hydraulic pump (26) operatively pumping fluid through said fluid delivery means (62) from said fluid reservoir (56) to said hydraulic vibration producing means (24) for vibrating said roller (22) to facilitate the compaction of the surface and to pump fluid back to said reservoir (56).

4. An assembly as set forth in claim 3 further characterized by said delivery means (62) including a valve means (64) and an arterial passage (66) extending between said valve means (64) and said second hydraulic pump (26) for providing fluid communication therebetween, said valve means (64) for selectively regulating the flow of fluid to and from said vibration producing means (24) on said roller means (18).

5. An assembly as set forth in claim 4 further characterized by said delivery means (62) including a control means (68) operatively connected to said valve means (64) for selectively regulating said valve means (64) to direct the flow of fluid to and from said vibration producing means (24) on said roller means (18).

6. An assembly as set forth in claim 5 further characterized by said delivery means (62) including a compactor delivery passage (70) extending between said valve means (64) and said vibration-producing means (24) for providing fluid communication therebetween and a compactor return passage (72) extending between said vibration-producing means (24) and said fluid reservoir (56) for providing fluid communication therebetween.

7. An assembly as set forth in claim 6 further characterized by delivery means (62) including a bypass passage (74) extending between said valve means (64) and a point in said compactor return passage (72) for providing fluid communication between said valve means (64) and said compactor return passage (72) to bypass the vibration-producing means (24) when said valve means (64) is in a predetermined bypass position.

8. An assembly as set forth in claim 7 further characterized by said delivery means (62) including a pump return passage (78) extending between said pump (26) and said fluid reservoir (56) for providing fluid communication therebetween and a relief passage (80) extending between said vibration-producing means (24) and said fluid reservoir (56) to provide a path for fluid flow when the hydraulic fluid pressure in the hydraulic vibration-producing means (24) exceeds a predetermined level.

9. An assembly as set forth in claim 8 further characterized by said vibration-producing means (24) and said roller (22) disposed within said housing (28) and at least one stabilizer (30) extending between said housing (28) and said vehicle (12), said stabilizer (30) being fixedly secured at one end to said housing (28) and pivotally connected at the opposite end to said vehicle (12).

10. A compaction roller machinery assembly (10) for compacting surfaces such as sand, said assembly (10) comprising; a vehicle (22) having a power plant for driving said assembly (10), roller means (18) extending in a cantilevered fashion from a pivot axis on said vehicle (12) for compacting a surface, said roller means (18) including a housing; roller lift means (20) mounted to said vehicle (12) and interconnecting said roller means (18) and said vehicle (12) for raising and lowering said roller means (18) about said pivot axis between a raised position and a surface-engaged position, said roller means (18) including a roller (22) for rolling and compacting surfaces and vibration-producing means (24) for vibrating said roller (22) to facilitate the compaction of the surfaces, said vibration-producing means (24) and said roller (22) disposed within said housing (28) and at least one stabilizer (30) extending between said housing (28) and said vehicle (12), said stabilizer (30) being fixedly secured at one end to said housing (28) and pivotally connected at the opposite end to said vehicle (12), said roller lift means (20) including a hydraulic cylinder (32) having a piston movable therein between first and second positions and a rod (34) extending from the piston exteriorly of the cylinder (32) and a piston delivery passage (36) for providing positive fluid pressure to one side of said piston in said cylinder (32) to move said rod (34) to its extended position and a piston return passage (38) for providing positive fluid pressure to the other side of said piston in said cylinder (32) to move said rod (34) to its retracted position to lift said roller means (18); said roller lift means (20) including a cylinder support means (40), said cylinder (32) pivotally connected at one end to said cylinder support means (40), said housing (28) including a mounting bracket (48), said rod (34) pivotally connected at the distal end to said bracket (48), said hydraulic cylinder (32) raising said roller means (18) to said raised position when said rod (34) is moved to its retracted position and lowering said roller means (18) to said lowered position once said rod (34) is moved to its extended position; said assembly further including a first hydraulic pump means for supplying said roller lift means (20) with hydraulic power for raising and lowering said roller means (18) and a second hydraulic pump means (26) disposed on said vehicle (12) for supplying hydraulic power to said hydraulic vibration producing means (24) on said roller means (18) to vibrate said roller (22) to facilitate compaction of the surface; said vehicle (12) including a fluid reservoir (56) for storing a quantity of fluid and a power take off shaft driven by said vehicle (12), said hydraulic pump means (26) including a hydraulic pump operatively connected to said vehicle (12) at the power take off shaft for driving said hydraulic pump (26); said assembly further including fluid delivery means (62) interconnecting with said vibration producing means (24) and said fluid reservoir (56) for providing fluid communication therebetween; said fluid delivery means (62) including a valve means (64) and an arterial passage (66) extending between said valve means (64) and said second hydraulic pump (26) for providing fluid communication therebetween, said valve means (64) for selectively regulating the flow of fluid to and from said vibration-producing means (24) on said roller means (18); said delivery means (62) further including a control means (68) operatively connected to said valve means (64) for selectively regulating said valve means (64) to direct the flow of fluid to and from said vibration producing means (24) on said roller means (18); delivery means (62) also including a compactor delivery passage (70) extending between said valve means (64) and said vibration producing means (24) for providing fluid communication therebetween and a compactor return passage (72) extending between said vibration producing means (24) and said fluid reservoir (56) for providing fluid communication therebetween; said delivery means (62) including a bypass passage (74) extending between said valve means (64) and a point in said compactor return passage (72) for providing fluid communication between said valve means (64) and said compactor return passage (72) to bypass the vibration producing means (24) when said valve means (64) is in a predetermined bypass position; said delivery means (62) further including a pump return passage (78) extending between said pump (26) and said fluid reservoir (56) for providing fluid communication therebetween and a relief passage (80) extending between said vibration producing means (24) and said fluid reservoir (56) to provide a path for fluid flow when the hydraulic fluid pressure in the hydraulic vibration producing means (24) exceeds a predetermined level.

11. An assembly as set forth in claim 10 further characterized by said cylinder support means (40) including a pair of opposing flanges (42) disposed in spaced relationship with respect to one another and fixedly secured to said vehicle (12), said hydraulic cylinder (32) including a hole disposed at the end opposite the said rod, said piston support means (40) including a pin (44) disposed through said hole in said hydraulic cylinder (32) and extending between said opposing flanges (42) for allowing said hydraulic cylinder (32) to pivot as said roller means (18) is raised and lowered.

12. An assembly as set forth in claim 11 further characterized by said mounting bracket (48) including a U-shaped flange having opposing sides (50) spaced from one another, said rod (34) including a hole disposed at the distal end thereof, said mounting bracket (48) including a mounting pin (54) disposed through said hole and extending between said opposing sides (50) of said U-shaped flange (48) for allowing said hydraulic cylinder (32) to pivot as said vibratory compaction roller means (18) is raised and lowered.

13. An assembly as set forth in claim 12 further characterized by said assembly including two stabilizers (30) extending between said housing (28) and said vehicle (12) and in parallel spaced relationship with respect to one another, said stabilizers (30) fixedly secured at one end to said housing (28) and pivotally connected at the opposite end to said vehicle (12).

* * * * *